US005119605A

United States Patent [19]

Sieber

[11] Patent Number: 5,119,605

[45] **Date of Patent: * Jun. 9, 1992**

[54] EXTERIOR INTERFACE SEALING SYSTEM

[76] Inventor: Steve C. Sieber, 2106 Apple Tree La., Silver Spring, Md. 20904

[ * ] Notice: The portion of the term of this patent subsequent to Nov. 6, 2007 has been disclaimed.

[21] Appl. No.: 572,421

[22] Filed: Aug. 27, 1990

Related U.S. Application Data

[63] Continuation of Ser. No. 355,843, Feb. 28, 1989, Pat. No. 4,967,519, which is a continuation-in-part of Ser. No. 239,603, Sept. 1, 1988, abandoned.

[51] Int. Cl.[5] ..... E04D 3/38

[52] U.S. Cl. ..... 52/60; 52/204

[58] Field of Search ..... 52/60-61, 52/58, 204, 209, 211, 416, 406-407; 49/493

[56] References Cited

U.S. PATENT DOCUMENTS

| | | | |
|---|---|---|---|
| 1,694,521 | 12/1928 | Tucker . | |
| 2,028,253 | 1/1936 | Spafford . | |
| 2,045,733 | 6/1936 | Spafford | 52/406 |
| 2,054,049 | 9/1936 | Cheney . | |
| 2,271,575 | 2/1942 | Waterman . | |
| 2,906,655 | 9/1959 | Blumenstein . | |
| 3,090,161 | 5/1963 | Edwards . | |
| 3,237,352 | 3/1966 | Edwards . | |
| 3,599,381 | 8/1971 | Gartner . | |
| 4,341,048 | 7/1982 | Minter . | |
| 4,489,527 | 12/1984 | Haas . | |
| 4,497,103 | 2/1985 | Hosooka et al. . | |
| 4,967,519 | 11/1990 | Sieber | 52/60 |

FOREIGN PATENT DOCUMENTS

| | | |
|---|---|---|
| 722681 | 3/1932 | France . |
| 214851 | 8/1941 | Switzerland . |

OTHER PUBLICATIONS

Bostick Spec-Data Sheet for Joint Sealer.
Euclid Chemical Company Product Information Book.
Napco, Inc. Aluminum Specifications for Trim Sheet Coil.

*Primary Examiner*—David A. Scherbel
*Assistant Examiner*—Michele A. Van Patten
*Attorney, Agent, or Firm*—Leydig, Voit & Mayer

[57] ABSTRACT

A sealing system and method particularly suited as a substitute for conventional exterior caulking of superstructure portal interfaces such as masonry walls and metal-framed windows where interfaces featuring a gap which are filled with a curable polymeric sealant, strips of J-shaped sill stripping are permanently mounted to the window frame and cover both the gap and sealant, additional caulk sealant is applied to the sill stripping and a finish veneer strip is interlocked with the sill stripping and press fitted against the masonry wall.

13 Claims, 2 Drawing Sheets

EXTERIOR INTERFACE SEALING SYSTEM

This application is a continuation of application Ser. No. 07/355,843, filed Feb. 28, 1989 which is a continuation of Ser. No. 07/239,603 filed Sep. 1, 1988, now abandoned.

TECHNICAL FIELD

This invention relates to an improved sealing method for sealing interfacing structures in buildings and the like and, more particularly, for a method of providing an improved seal between the exterior building veneer and dissimilar structures, such as metal-framed windows and doors.

BACKGROUND OF THE INVENTION

According to the National Energy Information Center of the United States Department of Energy, there are approximately 4,000,000 commercial buildings currently in existence in the United States, and each possesses a multitude of windows and doorways. Most of these buildings are of modern construction, involving masonry superstructure and metal-framed openings, i.e. doors or windows. It is necessary to periodically reseal the gaps found at the interface of the frames and superstructure to maintain an adequate environmental seal. In the case of larger buildings, it is necessary to erect scaffolding or the like for caulking operations. Also, in reference to residential structures, recent estimates indicate that some 45,000,000 windows will be replaced annually. The vast amount of resources and costs associated with window maintenance measures, given these exemplary figures, should be self-evident.

To seal gaps between superstructure veneers and window and door frames has been traditionally accomplished by injecting caulk of appropriate composition into the gap to prevent formation of passageways between the interior of the structure and the exterior. It is well known that once caulking fails, air and water can pass between the interior and the exterior of the building thereby resulting in potential water damage. Also, substantial energy loss is sustained due to exchange of warmed or cooled air from the interior of the building through to the exterior It is well known that a properly sealed structure both protects the building from adverse ambient terrestrial environmental conditions, especially precipitation, and conserves energy by reducing the quantity of energy required to achieve desired cooling and heating.

In order to maintain the integrity of joints formed between window frames and the superstructure of the building, periodic maintenance in the form of reapplication of caulk is necessary. Recaulking of the joint between the window frame and masonry wall generally is necessary every four to six years to achieve an adequate seal, particularly between a masonry structure (i.e. cement block, brick, etc.) and metal-framed windows commonly employed in commercial buildings and multiunit residential buildings. Although, generally adequate for its intended sealing purpose, this periodic reapplication of caulking is labor intensive and costly. Furthermore, unless the job is executed with reasonable care, an imperfect seal is obtained Although individually minor, such imperfections collectively cause energy wastage due to air transfer between the interior and the exterior of the building. Also, it is well known by any property owner that improperly applied caulking can lead to structural damage due to water seepage through joints.

Finally, irregularities in application will inevitably lead to smearing of caulk onto the abutting superstructure and window frame, as well as partial recessing and bubbling of caulk. Although providing sealing, such irregularities, occasioned by non-uniform application, are unsightly and unaesthetic. Where colored caulking is employed, irregular application may even require retouching or, worse, removal and reapplication.

A common practice, developed to address incomplete environmental caulking procedures, especially in the context of a metal frame/masonry wall interface, entails wedging a backer rod, generally a polyethylene or styrofoam strip, in the gap between the frame and masonry. This strip is then covered with a ⅛ to ¼ inch bead of caulking. Although this method, at least, partially addresses the problem of incomplete insulative sealing by filling the gap between the frame and window, it does not eliminate or even reduce the need for periodic reapplication. Furthermore, it does not eliminate or reduce the difficulties associated with application of the caulk in a manner to achieve a coherent long-term seal and a professional looking, finished product, which enhances the cosmetic appearance of the building. Hence, there is a need in the construction art to provide a sealing system, particularly in the context of metal frame/masonry construction so commonly used in commercial buildings, which provides a simplified method of environmentally sealing the frame to the masonry as well as enhancing the cosmetic appearance of the building.

SUMMARY OF THE INVENTION

It is, therefore, an object of this invention to overcome the problems specified above with the prior art installation systems and methods.

It is another object of this invention to provide a simple and elegant method of providing a coherent environmental seal between a building veneer structure and a dissimilar structure in a building which also enables a uniform and cosmetically pleasing appearance.

Yet another object of this invention is to minimize the necessity for routine maintenance of application of caulk to windows, doors and the like, especially in masonry metal frame structures.

Another object of this invention is to essentially standardize installation of a sealing structure between masonry and metal-framed portals.

Still another object of this invention is to provide a method for establishing an effective long-term caulking system which is satisfied by a method for producing an environmental seal in a cavity between two adjoining structural members, comprising the steps of:

providing a first layer of environmental insulating material to at least partially fill the cavity, applying a first strip defining a flange and a first element of a cooperating locating member, the flange being sized to cover a length of the cavity, permanently attaching said first strip to one of the structural members where the flange covers the selected cavity length, applying a layer of caulk to the first strip, selecting a finish strip including the second element of the cooperating locating member and dimensioned to overlie the first strip, engaging the first and second elements to locate the finish strip on the first strip so that the finish strip overlies the first strip and the layer of caulk.

In essence this invention is relatively elementary and provides a sealing or capping system contemplated to seal the interface of superstructure members, as, for example, a portal frame such as a door or window to a dissimilar wall structure contiguous thereto (masonry, block, glass, composites, etc.). The principal components of the system are caulking, a main seal strip featuring a J-hook which is permanently mounted to the superstructure, and a pressure-bent finish veneer strip which inserts into the hook, overlaps the main sill strip and the caulking, and press fits against the wall where the combination protects the underlying seal and provides a uniform exterior appearance to the sealing system.

The installation of the system is extremely cost-effective, when its useful longevity is many times that of ordinary caulking. Since reapplication of caulk requires erection of scaffolding or working platforms for large buildings, this labor-intensive step need only be performed once, given the decades of useful life of the instant invention. Moreover, when the main seal strip and veneer strip are properly sized, a crew of three persons can conservatively install the system on as many as thirty-three windows a day. These and other benefits of the instant invention should become apparent to the person of ordinary skill in the art, given the following detailed description of the invention.

DETAILED DESCRIPTION OF THE INVENTION

Figure 1:
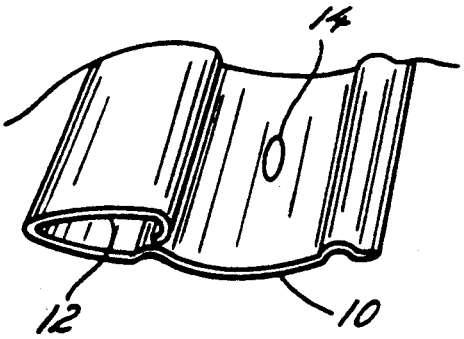
FIG. 1 illustrates a partial strip of the main sill trim employed in the invention.

FIG. 1 illustrates a portion of main sill stripping 10 featuring a J-shaped cross-sectional configuration thereby providing hook 12 along one edge. Hook 12 has a maximum depth of approximately ¼ inch and a width of approximately ¾ inch. The depth of hook 12 triangulates, but to provide an approximate ⅛" gap is bent along its internal edge to define a J-shaped structure. Also depicted in FIG. 1 is prefabricated rivet or screw hole 14. This feature is not necessary but in the event of mass production of sill stripping conforming to this invention, it would facilitate fastening of sill stripping 10 to a window frame. Such main sill stripping is commercially available from a number of sources, as for example, MidSouth Building Supply Co. Generally, main sill stripping 10 is formed from maintenance free aluminum coil stock possessing physical characteristics of finish veneer stripping 16 described below which can be formed of different gauge aluminum stock (0.015–0.032 inch and preferably 0.019 inch) and is prefabricated to include hook 12. Although, prefabricated aluminum main sill stripping of the described configuration is commercially available, to reduce costs in large volume application, the installer can convert flat raw aluminum coil stock with a sheet metal extruder and punch to provide hook 12 and hole 14, respectively. In the preferred, but slightly more expensive application, strip 10 is coated with a polyvinyl chloride resin, containing an appropriately colored pigment selected to match or approximate the architectural colors of the building and frame to which it is applied. For example, if the window frame is chocolate brown-colored, the main sill strip should be similarly colored.

Figure 2:
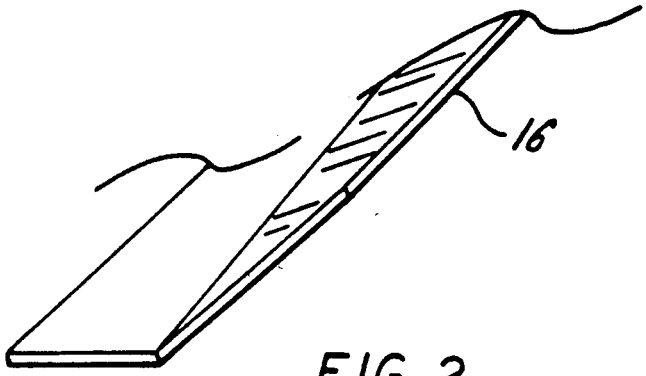
FIG. 2 illustrates a partial strip of the finish veneer employed in the invention.

Moving to FIG. 2, it depicts a continuous smooth strip of aluminum coil stock which has been pressure-bent to a 20–60° angle, and preferably between 30° and 45°. Preferably, strip 16 is coated with a long-term protective coating such as pigmented polyvinyl chloride to provide enhanced protection to the aluminum as well as possessing the color to blend architecturally with the structure upon which it is applied, as well as to correspond to the color of main sill stripping 10. Given installation procedures defined below, finish veneer strip 16 does not require, and thus does not include any surface discontinuities such as holes for application of this system. The aluminum coil stock material comprising finish veneer strip 16 is commercially available, as for example, from Napco, Inc., as 0.019 inch trim sheet coil composed of a 3105H16 or equivalent alloy exhibiting a +0.020–0.012 inch width tolerance, a lateral bow of 0.125 inches in 144 inches, and an elongation of 1% in 2 inches. This aluminum stock is coated with a colored polyvinyl chloride resin and is available in a Alumelure 2000 finish from VIPCO (Vinyl Improvement Products Co.) of Columbus, Ohio.

Field measurements determine the length of strips 16, which are then prefabricated in a shop remote from the field site, or, (if desired), the appropriate sizing and cutting tools such as a sheet metal brake, can be employed at the field site. If cut in a remote factory, the strips can be fabricated to a length of up to two inches longer than necessary, so final sizing and cutting is then performed by the field worker.

The width of strips 16 is also governed by the particular requirements of the installation. For this reason, it is advantageous to maintain a supply of veneer strips possessing a variety of standardized widths in a variety of colors. The width of veneer strips 16 must be adequate to interlock with hook 12, extend across the base of main sill strip 10 and abut the contiguous superstructure. As a practical note, strip 16 should be of sufficient flexibility and flexural strength to conform to the relief and contour of the superstructure wall. For example, since a brick sill presents an uneven surface, finish veneer strip 16 should flexibly distort to urge it over projections, partially to recess into the crevices between the bricks and to otherwise somewhat conform to irregularities in the wall contour.

Figure 6:
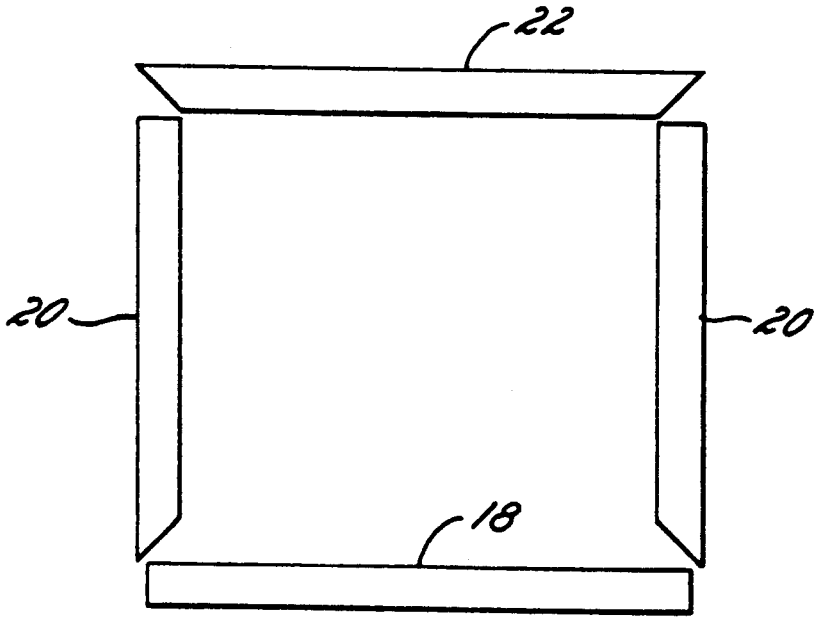
FIG. 6 is an exploded view of the counterflashed finish veneer strips as applied in the practice of this invention.

Generally when cut to appropriate size, finish veneer strips 16 conform to the pattern identified in FIG. 6. That is, bottom strip 18 possesses a rectangular configuration while side strips 20 feature an angled edge at the bottom and a rectangular edge at the top. Upper strip 22 is of a trapezoidal configuration possessing both edges being angled at 45°. Hence, upon application, the finish veneer trim not only gives the appearance of possessing mitered corners for aesthetic purposes, but also, and more importantly, provides counterflashing to prevent undesirable leakage from gravitational flow of water along the window frame.

Figure 3:
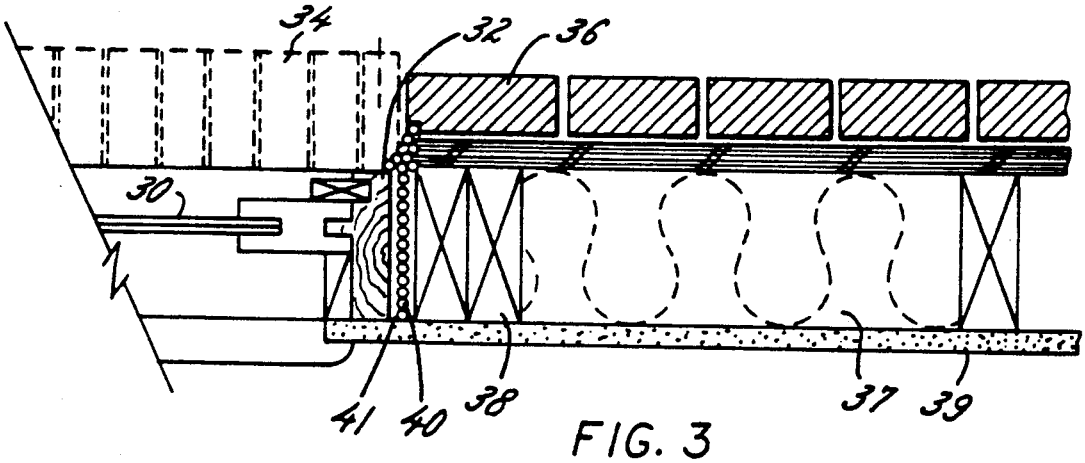
FIG. 3 is a diagrammatic cross-sectional representation of the first caulking operation of the invention.
Figure 4:
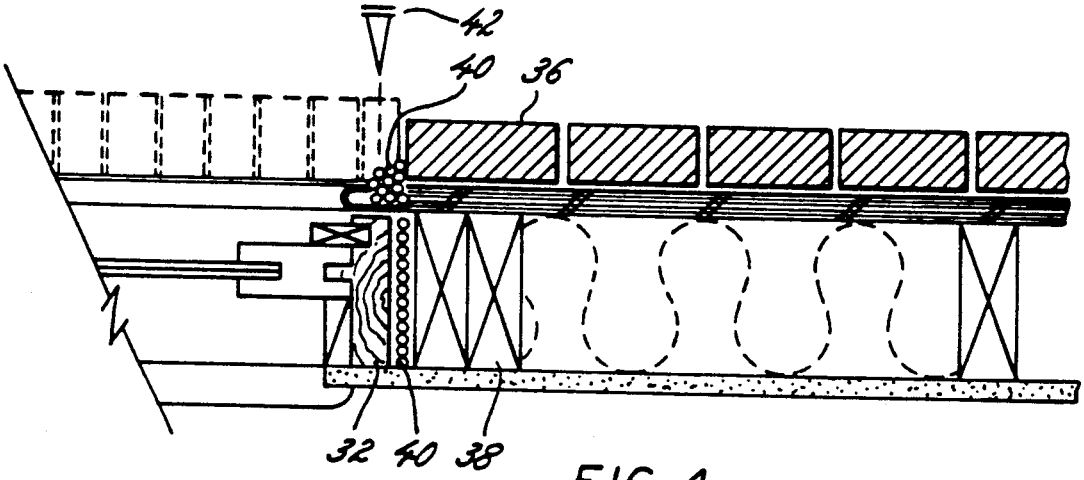
FIG. 4 is a diagrammatic representation of the installation of the main sill trim piece and second caulking step.
Figure 5:
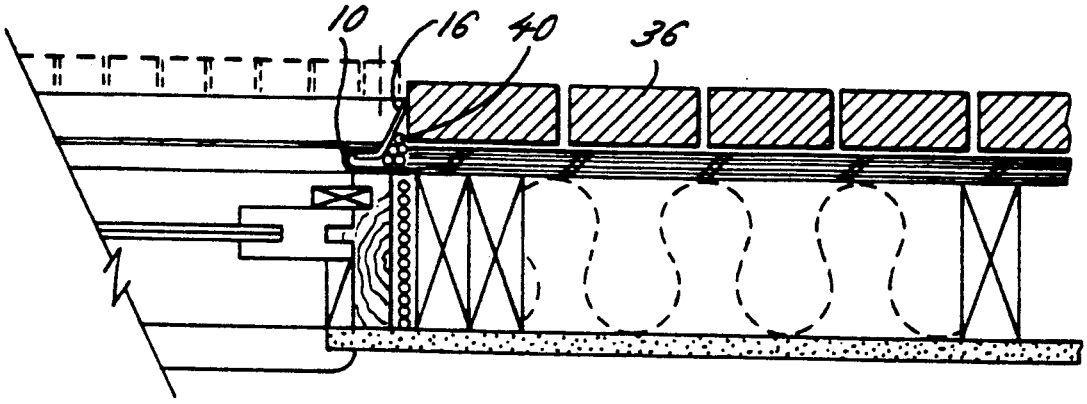
FIG. 5 is a cross-sectional illustration of the finished sealing system including the finish veneer strip in accordance with this invention.

Moving now to FIGS. 3 through 5, the relationship of the components of the invention as applied to the masonry/window frame interface is depicted. In FIG. 3, windowpane 30, contained within metal frame 32, and seated within window sill 34, is illustrated. Frame 32 is contiguous to and substantially abuts support studs 38 which lie between the edge of brick wall 36 and interior wall 39. As is conventional in modern construction, the void defined by masonry wall 36, studs 38 and internal wall 39 is filled with appropriate insulation 37. Long-lasting caulking 40, preferably a curable clear color, transparent, non-sag, gun-grade, urethane sealant composition, such as that commercially available from the Euclid Chemical Company of Cleveland, Ohio as Eucolastic 1 complying with Federal specification TT-S-00230C, Type II, Class A and ASTM Standard C920-79, Type S, Grade NS, Class 25. The actual physical properties demonstrated by such material include no flow or deformation at 40° and 122° F., hardness of 40, 9% weight loss, 30 hour tack-free time, and adhesion-in-peel of 18–22 pli for aluminum and 19–23 for brick. Other sealants useful in the practice of this invention are Bostik Chem-Caulk ® 900, or even Ailicon caulk. The caulk is injected into and fills gap 41 between frame 32, studs 38 and brick wall 36. Main sill strip 10 is then permanently affixed to frame 32 with screw 42, causing one edge of sill strip 10 to abut the superstructure wall, and in this example, the joint between stud 38 and brick wall 36 (See FIG. 4). Following installation of main sill strip 10, a second layer of caulk 40 is applied onto its flat portion. The final sealing structure is achieved, as depicted in FIG. 5, when finish veneer strip 16 is permanently positioned over the second caulk layer by pushing one edge into hook 12 of sill strip 10 and pressing the opposite edge to compress and otherwise press fit against brick wall 36.

Given the foregoing description of the structures of the invention in relationship with those structures to a window frame, the following constitutes a guide to the method for installation of the invention.

First, when the invention is applied to a building with caulking already in place and in need of repair, the installer should eliminate the existing bead of caulking. In general, the existing bead of old caulking is only between ⅛ and ¼ inch thick, so it can be either stripped off or, with a hammer and chisel, forced into cavity 41 between the window frame and the masonry wall. Of course, this step is unnecessary where the invention is first applied to new construction.

Once the old caulking is disposed of, urethane caulking 40 is injected into the cavity with an appropriate gun or injector, in a manner to substantially fill the cavity (see FIG. 3). In the next step, main sill strip 10 through holes 14 is mounted directly to window frame 32, preferably to abut brick wall 36, with rivets, screws, etc. (see FIG. 4), and compresses the underlying caulk into the cavity. Since, as explained above, the width of the strip is greater than that of the cavity, the overlapping flange allows for a degree of imperfect alignment during installation without necessitating removal and reinstallation of the entire strip. Hook (keeper) 12 of the sill strip comprises part of the overlap and projects out from the window frame when properly installed. It is recommended that strip 10 be counterflashed, i.e. installed to accommodate gravitational water flow. Therefore, in conformity with the installation pattern of finish veneer strips 18, 20 and 22 illustrated in FIG. 6, the square-cut bottom sill strip is first installed. The strip is sized to extend the entire width of the bottom of the sill. Next, the two side pieces are installed. The length of the long edge of these pieces extends from the bottom of strip 18 to the top of the window frame while the shorter, inside edge extends from the top of bottom strip 18 to the top of the window frame. The final strip installed is the upper crosspiece (lintel) which features an upper edge length extending the width of the frame and a lower edge length corresponding to the distance between the interior edges of the two side sill pieces, thus defining a trapezoidal configuration.

As stated above, after installing the main sill stripping, another layer of silicone caulking 40 is applied to the outer surface of the sill strips in sufficient quantity to both cover the screws (rivets) and holes 14 and also provide a substantial bead of caulking which extends to the junction of brick wall 36. Once so applied, finish veneer pressure-bent coil strip 16 is checked for appropriate size (trimming may be done by the installer at the site). The interior edge is seated in hook 12 of main sill strip 10 and pushed to press fit the strip, whereby strip 16 is properly positioned and secured by frictional engagement between the brick wall and hook 12 of main sill strip 10 (see FIG. 5). Once again, as illustrated in FIG. 6 in an exploded view, finish veneer strips 16 are counterflashed with bottom strip 18 being installed first, side strips 20 being installed secondly, and, lastly, upper strip 22 being installed. In order to provide the appearance of a mitered joint, the lower strip 18 is squared, side strips 20 include one end featuring a 45° angle cut and upper strip 22 provides a trapezoidal configuration with both ends being cut at 45° angles. Thus, a framed sealing system is established. In certain installations, depending on the angles and the width of finish veneer strips 16, it may not be desirable to angle side pieces 20 to avoid formation of gaps between lower finish veneer piece 18 and the two side pieces. Hence, upper strip 22 and/or side pieces 20 may be square-cut. To determine the need for square-cut pieces, depends on the particular situation and the installer must make a decision based on the circumstances of the particular structures involved.

It should be appreciated that, due to the flexibility of strips 16, the edge of the veneer strip tends to follow the contour of brick wall 36, i.e. it will partially bulge over protrusions in the masonry and recess in the crevices formed by cement between the individual bricks.

Briefly summarizing the installation steps, the installer fills the cavity between the frame and masonry with caulk, fastens the hooked main sill strip to the frame over the caulking, and applies more caulking to the outer surface of the main sill strips. Finished veneer strips are then snapped into the main sill strip, and some caulking is pressed out from between the main sill strip and the finish veneer strip. However, since the caulking is clear, when applied in proper amounts, there is little wastage and the excess caulk will not mar the professional, cosmetic and aesthetic appearance of the finished installation. Furthermore, no nails or rivets are visible, thus not detracting from the smooth, continuous finish provided by the invention.

The described installation procedures have referred to the environment of a masonry wall and metal frame window. It should be readily apparent to the person in the ordinary skill of the art that the triple environmental seal of the invention can be employed for any masonry/metal interfacing portal; doors, air conditioning grills, etc., and, for that mat ancillary structural members such as awnings, abutting exterior wall panels, to provide a frame-like, leak-proof seal. Also, the invention is equally employable with wooden frame and wooden structures, as it is in the above-described metal/masonry construction. Given the intention of this invention to provide a secure environmental seal, as well as a pleasing, cosmetic finish to any structural interfaces in buildings, the many variations and modifications now apparent to the person of ordinary skill in the art, given the foregoing, are contemplated to fall within the scope and intent of this invention which is defined by the following claims.

I claim:

1. A method for providing an environmental seal in the interface of a superstructure and a framing member having a cavity disposed therebetween, comprising the steps of:

filling at least a portion of the cavity with an environmental insulating material, sizing a securing member featuring a first element of a cooperating attachment device and defining a flange extending a pre-selected distance sufficient to cover the cavity and the insulating material, permanently affixing the sized securing member to cover the cavity, applying an environmental sealant to the securing member flange, sizing a covering member to correspond with the sizing of the securing member where the covering member includes a second element of the cooperating attachment device, fitting the covering device over at least a portion of the securing device and the environmental sealant, engaging the first and second elements, and attaching the covering member to the securing member to fixedly positionally stabilize the covering member relative to the superstructure over the environmental sealant.

2. A method according to claim 1 where the environmental insulating material and environmental sealant are injectable caulk and further comprising the steps of injecting the caulk into the cavity and pressing the covering device causes the caulk to flow into irregularities on the superstructure proximate to the covering device.

3. A method according to claim 1 where the environmental sealant is a substantially colorless, curable urethane-based caulk and where covering device possesses a sufficient width to completely overlie the flange, further comprising the steps of, pressing the covering device to cause the caulk to substantially cover the securing member flange and to flow into irregularities on the superstructure proximate to the covering device before curing.

4. A method according to claim 1 where the securing member and covering device are elongated strips sized to correspond to the length and width of a window frame, further including the step of pressure bending the covering device to form a substantially central seam extending in the direction of elongation.

5. A method according to claim 1 further including the step of coating the covering devices with an environmentally protective coating possessing a desired color.

6. A method according to claim 5 further including the step of at least partially similarly coating the securing member.

7. A method according to claim 5 further including counterflashing the securing member and covering device.

8. A method according to claim 7 further including the step of beveling selected ends of the covering device to provide a mitered appearance.

9. A method according to claim 1 including the step of applying an environmental sealant to substantially cover all of the securing member flange.

10. A method for producing an environmental seal in a cavity between two adjoining structural members, comprising:

providing a first layer of environmental insulating material to at least partially fill the cavity, applying a first strip defining a flange and a first element of a cooperating locating member, the flange being sized to cover a length of the cavity, permanently attaching said first strip to one of the structural members where the flange covers the selected cavity length, applying a layer of caulk to the first strip, selecting a finish strip including the second element of the cooperating locating member and dimensioned to overlie the first strip, engaging the first and second elements to locate the finish strip on the first strip so that the finish strip overlies the first strip and the layer of caulk.

11. A method according to claim 10 where said flange is attached to and extends directly from the first strip and further comprising the step of cutting the second covering means to provide a mitered appearance when installed.

12. A method according to claim 10 where the layer of caulk covers at least the edge of the flange.

13. A method for providing an environmental seal for the abutting region of a superstructure and a framing member, comprising the steps of:

applying an environmental insulating material to the abutting region, sizing a securing member defining a flange extending a pre-selected distance sufficient to cover the abutting region and the insulating material, permanently affixing the sized securing member to cover the cavity, applying an environmental sealant to the securing member, sizing a covering member to correspond with the sizing of the securing member, fitting the covering device over at least a portion of the securing device and the environmental sealant, affixing the covering member to fixedly positionally stabilize the covering member relative to the superstructure and the securing member and to overlie the environmental sealant.

* * * * *